United States Patent [19]

Brooks et al.

[11] Patent Number: 4,930,642

[45] Date of Patent: Jun. 5, 1990

[54] MERCHANDISE DISPLAY SYSTEM

[76] Inventors: Lynwood C. Brooks, 58 Indian Pipe, Painted Post, N.Y. 14870; Lloyd J. Fuller, 107 Central Ave., Elkland, Pa. 16920; Randolph J. Russo, 6 Wyndham Ct., Nanuet, N.Y. 10954; Robert P. Russo, 1 Georgetown Oval, New City, N.Y. 10956

[21] Appl. No.: 295,099

[22] Filed: Jan. 9, 1989

[51] Int. Cl.[5] ..... A47F 7/00

[52] U.S. Cl. ..... 211/71; 211/181; 248/311.2

[58] Field of Search ..... 211/181, 175, 71, 126; 248/310, 311.2, 315, 346

[56] References Cited

U.S. PATENT DOCUMENTS

| | | | |
|---|---|---|---|
| 783,505 | 2/1905 | Burt | 211/71 |
| 1,956,678 | 5/1934 | Hanson | 211/181 X |
| 2,820,446 | 1/1958 | Freeman | 248/311.2 X |
| 3,814,360 | 6/1974 | Samuelian, Sr. et al. | 248/311.2 X |
| 3,856,173 | 12/1974 | Deane et al. | 211/71 X |
| 4,848,217 | 7/1989 | Koziol | 211/181 X |

*Primary Examiner*—Robert W. Gibson, Jr.

[57] ABSTRACT

A merchanidse display system is provided which includes a plurality of wire frame members, each of which has an opening or cavity for receiving and holding goods which are to be displayed. The frames are supported on two types of base members: one for displaying goods horizontally (flat bases) and one for displaying goods on an angle (angled bases). The display system is assembled by connecting frame members to base members, and by then connecting adjacent frame members to one another to produce a unitized overall display for the goods. In certain preferred embodiments, the connection between adjacent frame members is made by means of handles formed as part of the frame members and, in particular, by the top portions of such handles. To allow frames carried by angled bases to be connected to frames carried by flat bases, the top portions of the handles on, for example, frames used with flat bases are angled so that when assembled on a flat base, the top portion of the handle lies in the same plane as the top portions of handles on frames assembled on angled bases.

20 Claims, 5 Drawing Sheets

FIG. 6.
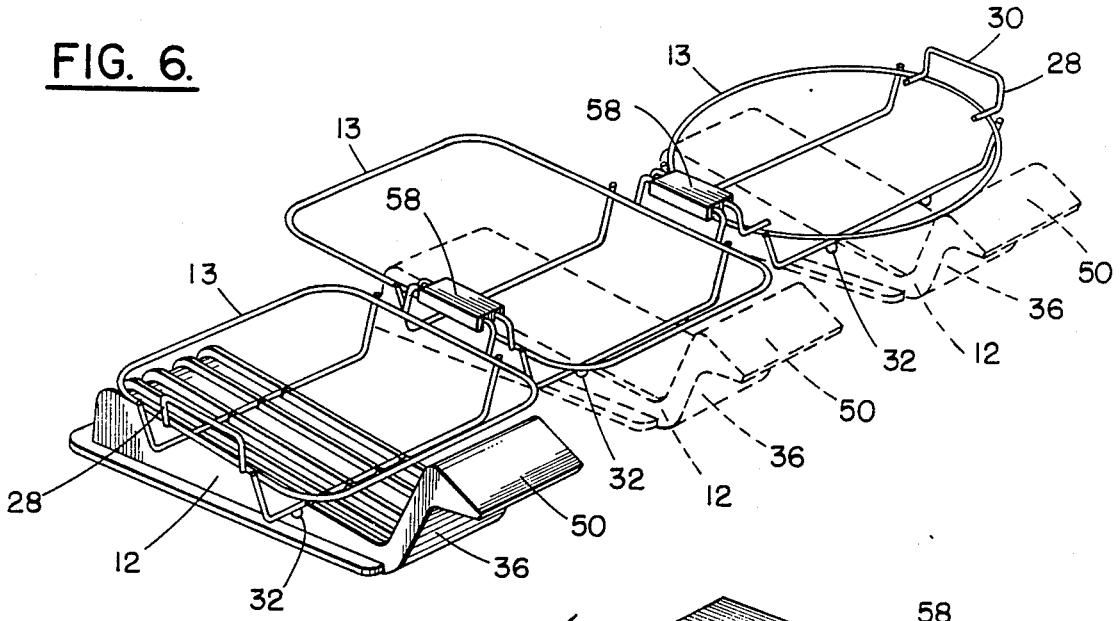
FIG. 7.
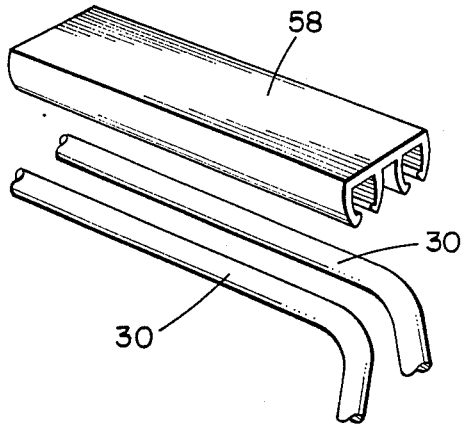
FIG. 8.
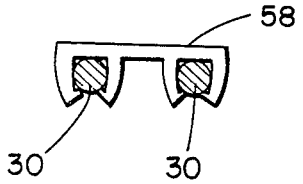
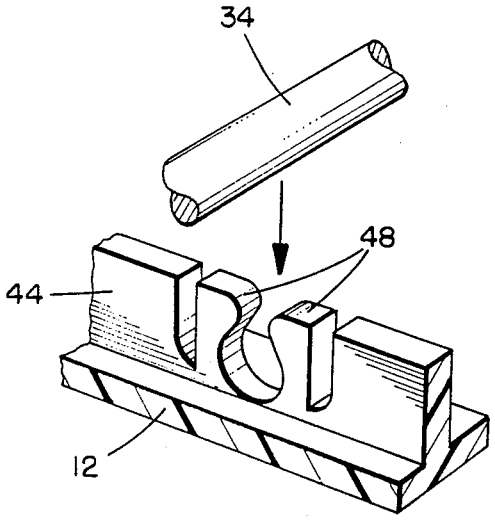
FIG. 9.
FIG. 10.
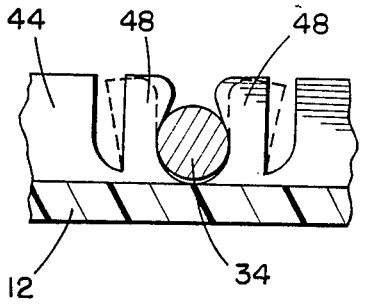

MERCHANDISE DISPLAY SYSTEM

BACKGROUND OF THE INVENTION

1. Field of the Invention

This invention relates to merchandise display systems and, in particular, to display systems for use with merchandise having a variety of shapes and sizes, such as glass bakeware.

2. Description of the Prior Art

The two fundamental problems facing manufacturers and distributors of goods sold at retail are (1) obtaining sufficient shelf space for their goods and (2) presenting the goods to the customer in a pleasing and informative manner. These problems are accentuated when a family of goods having different sizes and shapes is to be displayed. The presentation problem is also more difficult when the goods are breakable, since in addition to being presented in a commercially effective manner, the goods must also be presented in a way in which they are not likely to be broken.

One type of merchandise which has been found particularly difficult to display effectively is glass bakeware. Typically, a manufacturer will produce a full line of bakeware, including, loaf, casserole, cake, cookie, pizza, and pie dishes, along with various types of mixing bowls. Normally, there is no clear, definable space on the retailer's shelf for any particular item. As a result, it is not uncommon for a retailer to place overstocks for one item in the place where another item should be displayed. Along these same lines, once a product sells out, the only thing left to reserve the product's space on the shelf is a tag provided by the retailer, and thus shelf space can be easily lost to competing products.

In addition to these problems, to date, there has been no safe and effective way to display glass products on an angle so that labels placed on the bottom, inside surface of the product, e.g., at the bottom of a baking dish, can be seen by the customer. Typically, the bottom, inside surface of the product is the largest area available for providing written and graphic information to the consumer at the point of sale.

SUMMARY OF THE INVENTION

In view of the foregoing state of the art, it is an object of this invention to provide a merchandise display system which (1) will display a variety of items of different shapes and sizes on a retailer's shelf, each item having a reserved space on the shelf, (2) will safely display selected items (including breakable items) on an angle so that labels within the item can be viewed by the customer, and (3) will allow different items in a family of items to be displayed next to one another irrespective of their particular size and shape.

To achieve the foregoing and other objects, the invention provides a display system comprising a plurality of frame members, e.g., wire frame members, each of which has an opening or cavity for receiving and holding goods which are to be displayed. So that the system can display goods have different shapes, the configurations of the openings differ among at least some of the frames, with at least one opening corresponding to each of the goods which are to be displayed.

The frames are supported on base members. Preferably, the system includes two types of base members: one for displaying goods horizontally, and a second base member for displaying goods on an angle. The frame members and base members are preferably removably (releasably) connected together. When connectable in this manner, each type of base member can be used with a plurality of frame members having different cavity configurations, e.g., horizontal base members can be used with frame members having, for example, square, rectangular, and circular cavities of particular sizes, and similarly, angled base members can be used with frame members having cavities with the same or different shapes and sizes.

The frame members and base members are used to produce the overall display as follows. First, if not previously connected, the frame members are connected to the base members. The particular frame and base members used will depend on the particular goods to be displayed and on whether those goods are to be displayed horizontally or at an angle. The frame-member/base-member units are then arranged on the retailer's shelf in whatever order the goods are to be displayed. Finally, adjacent frame members are removably (releasably) connected to one another to produce a unitized overall display for the goods, with each location in the display being for a particular type of good. In this way, individualized shelf space for each of the goods which is to be displayed goods is created and maintained even if all of that type of good has been sold.

The connection between adjacent frame members is preferably made by means of handles formed as part of the frame members, and more preferably by the top portions of such handles. The handles and, in particular, the top portions of the handles can be easily connected to one another by means of snap-type connectors made of, for example, plastic. To allow frames carried by angled bases to be connected to frames carried by horizontal bases, in the most preferred embodiments of the invention, the top portions of the handles on, for example, frames used with horizontal bases are angled so that when assembled on a horizontal base, the top portion of the handle lies in the same plane as the top portions of handles on frames assembled on angled bases.

The accompanying drawings, which are incorporated in and constitute part of the specification, illustrate the preferred embodiments of the invention, and together with the description, serve to explain the principles of the invention.

BRIEF DESCRIPTION OF THE DRAWINGS

FIG. 6 is a perspective view illustrating three frame member/base member combinations connected to one another to form a unitized display.

FIG. 7 is an expanded, perspective view of the handles of two adjacent frame members illustrating the connection of the top portions of those handles to one another by means of a snap connector.

FIG. 8 is a cross-sectional view illustrating the snap connector of FIG. 7 in its assembled condition on the handles of the adjacent frame members.

FIGS. 9 and 10 are perspective and cross-sectional views, respectively, illustrating the connection of the frame member to the base member.

DESCRIPTION OF THE PREFERRED EMBODIMENTS

Figure 1:
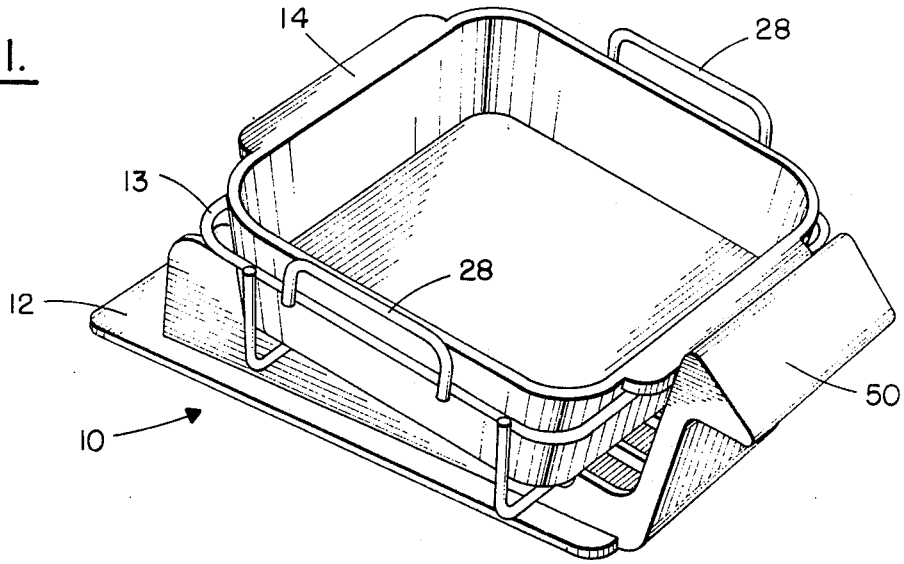
FIG. 1 is a perspective view of a basic unit of the display system of the present invention employing an angled base member and a frame member designed to receive an item of merchandise having a generally square configuration, e.g., a cake dish.
Figure 11:
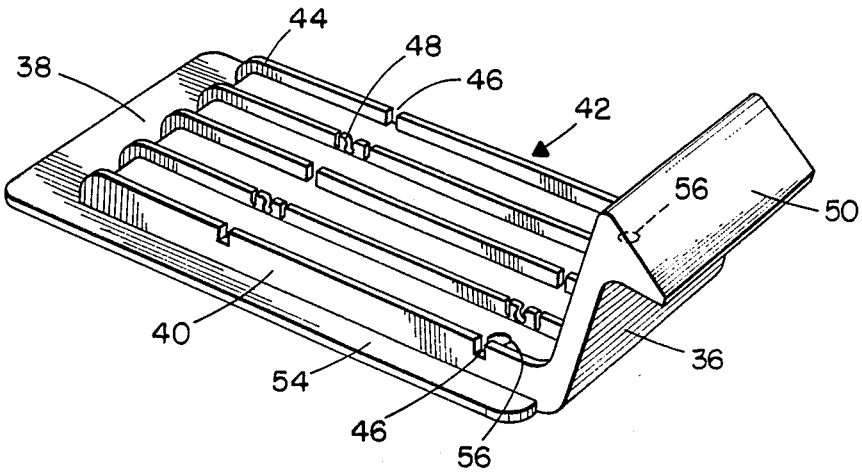
FIG. 11 is a perspective view of a flat base member.

With reference now to the drawings, wherein like reference characters designate like or corresponding parts throughout the several views, there is shown in FIG. 1 a basic unit 10 of the merchandise display system comprising base member 12 and frame member 13. As shown in this figure, base member 12 is of the type which holds merchandise 14 at an angle above the horizontal, e.g., at an angle of approximately 10° (referred to herein as an "angled base member"). A base member which holds the merchandise substantially horizontally is shown in FIG. 11 (referred to herein as a "flat base member" or a "horizontal base member").

Figure 2:
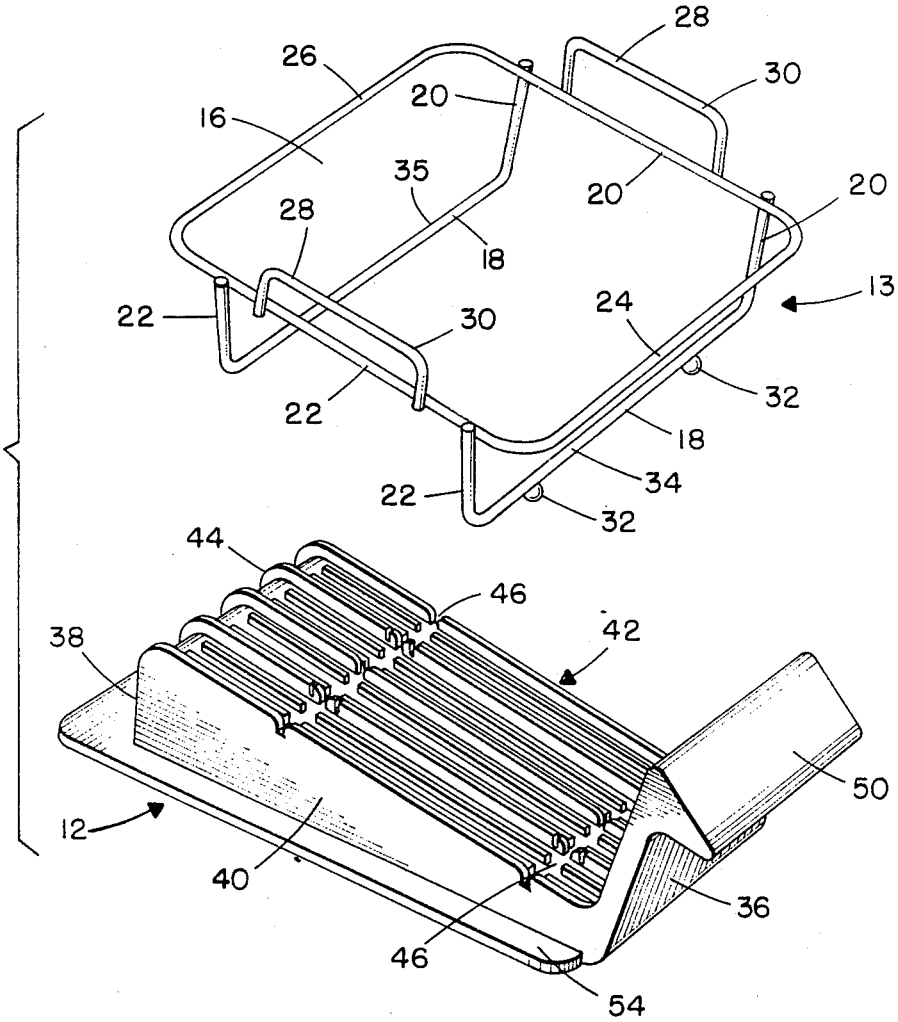
FIG. 2 is an exploded view of the frame member and angled base member of FIG. 1.

As shown in FIG. 2, frame member 13 is preferably composed of connected segments of, for example, wire or plastic coated wire so as to form a "wire basket" for the merchandise. The wire segments together define top 16, bottom 18, sides 20 and 22, front 24, back 26, and handles 28 of the frame member. They also define a cavity and an opening to the cavity at top 16 for receiving merchandise 14. Specifically, the cavity comprises the volume between the front, back, sides, top and bottom of the frame member which is occupied by the merchandise when the merchandise is received in the frame member. The depth of this cavity, i.e., the distance between the top and bottom of the frame member, is chosen so that the merchandise, when received in the cavity, is held in place and, in particular, for angled base members, is chosen so that the merchandise is held in place when displayed at an angle.

Figure 12A:
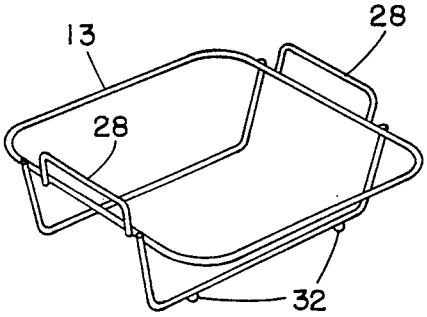
FIGS. 12A–12D are perspective views of four illustrative frame members.
Figure 12B:
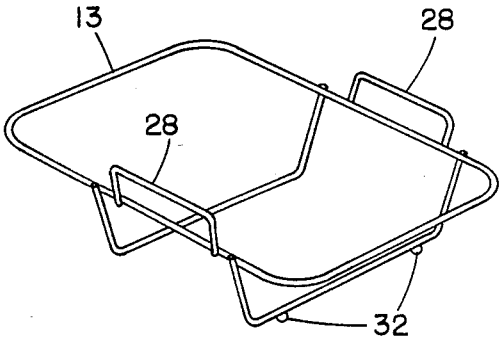

Both the cavity and the opening have configurations which correspond to the outside surface of the merchandise. For example, in FIG. 1, the cross-section of the merchandise is square-shaped, and thus the cavity and the opening to the cavity have generally square-shaped cross-sections. Other typical configurations for the frame member are shown in FIG. 12B (rectangular cross-section) and FIG. 12D (circular cross-section). Configurations other than those shown can, of course, be used if desired.

Handles 28 extend upward from the top of the frame member and preferably include top portions 30 which, as discussed below, are used to connect adjacent frame members to one another to form the fully assembled display system.

Frame member 13 also includes locator balls 32 carried by wire segment 34. These balls are used to align the frame member with the base member. In addition, as discussed below, the locator balls are used to prevent frame members designed for use with angled base members from being used with flat base members, and vice versa.

Figure 5:
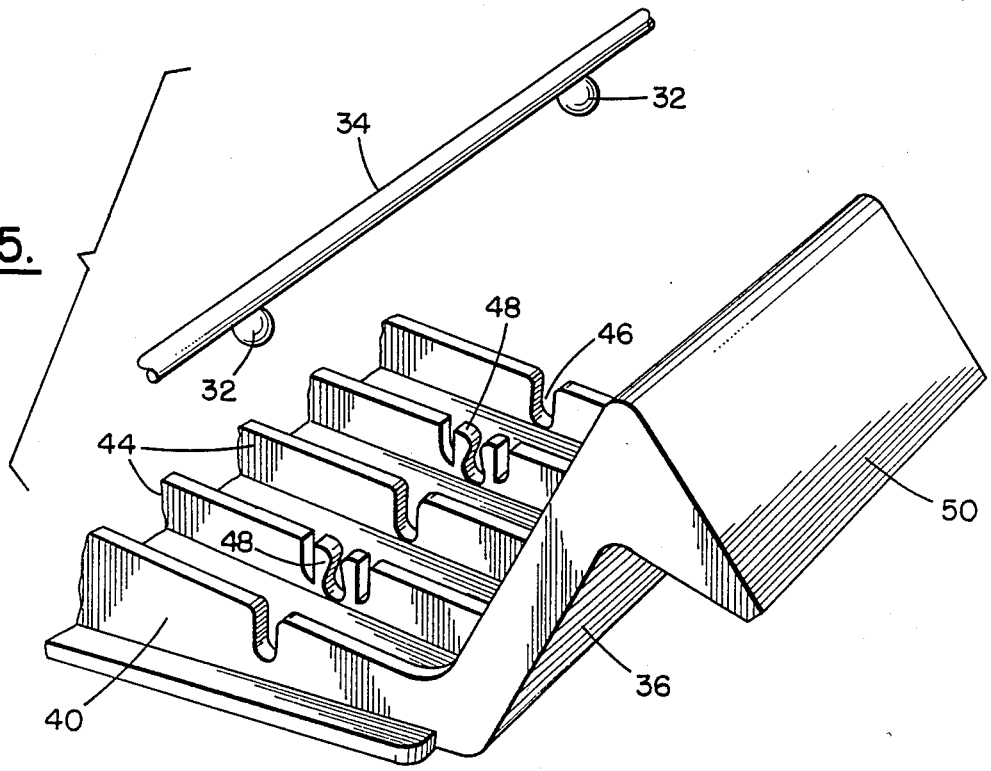
FIG. 5 is an expanded, perspective view of the front portion of the angled base member of FIG. 1 illustrating the connection of the frame member to the base member.

Base member 12, which can be made from, for example, a molded plastic material, includes front 36, back 38, sides 40, and supporting surface 42 defined by the top surfaces of ribs 44. Ribs 44 include channels 46 for receiving wire segments 34 and 35 of frame member 13. As shown most clearly in FIGS. 5, 9, and 10, some of the ribs, e.g., the second and fourth ribs, include resilient members 48 which spread apart and then spring back to capture the wire segments and thus secure the frame member to the base member. Other means for securing the frame member to the base member can be used if desired, such as, straps, hooks, and the like.

Front 36 of base member 12 includes angled panel 50 for carrying an identification of the merchandise being displayed. Base member 12 can also include feet 52 made of a high coefficient of friction material, e.g., a rubber-type material, to help prevent movement of the display system during use.

Figure 3:
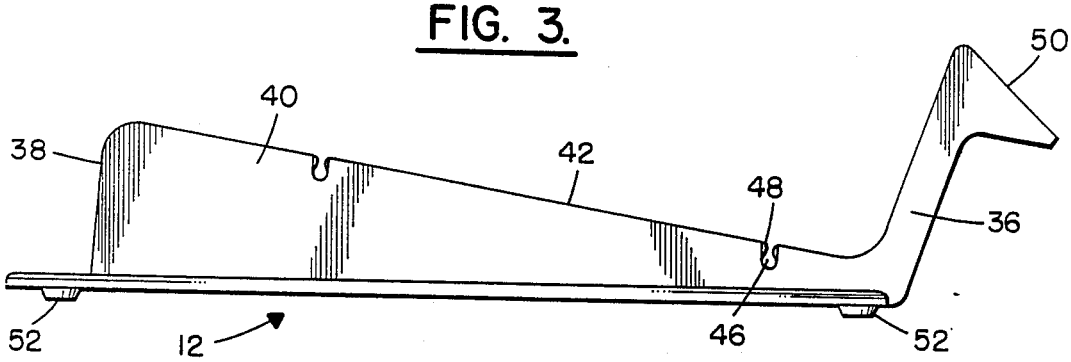
FIG. 3 is a side view of the angled base member of FIG. 1.
Figure 4:
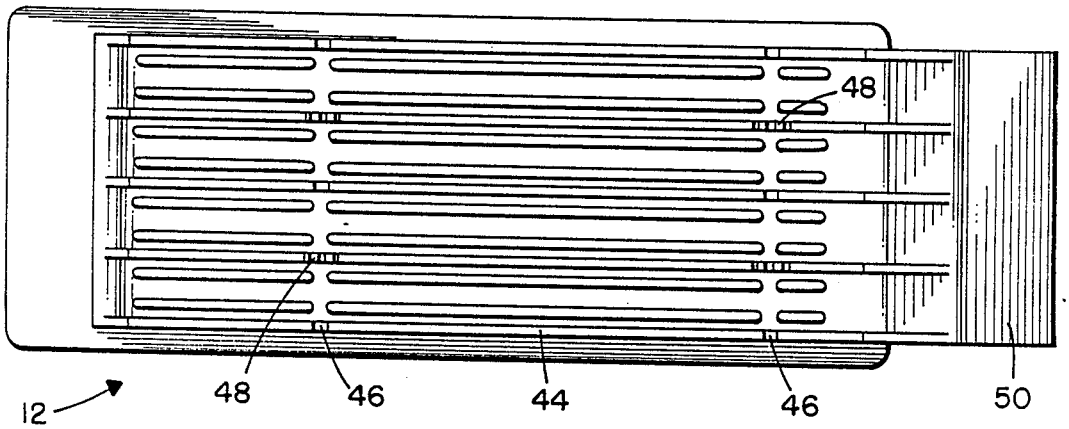
FIG. 4 is a top view of the angled base member of FIG. 1.

For angled base members, such as shown in FIGS. 2–4, supporting surface 42 slopes upward from front 36 to back 38. For flat base members, such as shown in FIG. 11, supporting surface 42 is substantially horizontal.

In addition to the orientation of their supporting surfaces, the flat and angled base members also differ with regard to their mechanisms for receiving locator balls 32. Specifically, the flat base members include apertures 56 for receiving the locator balls, while the angled base members do not include such apertures. Conversely, for the flat base members, the distance between the top of skirt 54 and the bottom of front channel 46 is less than the height of a locator ball, while for an angled base member, this distance is greater than the height of a locator ball.

Figure 12C:
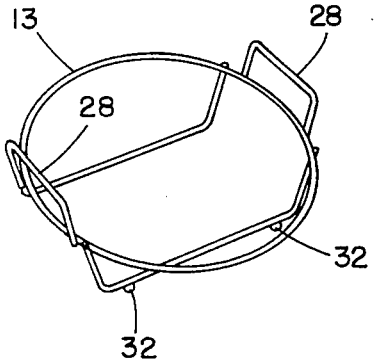
Figure 12D:
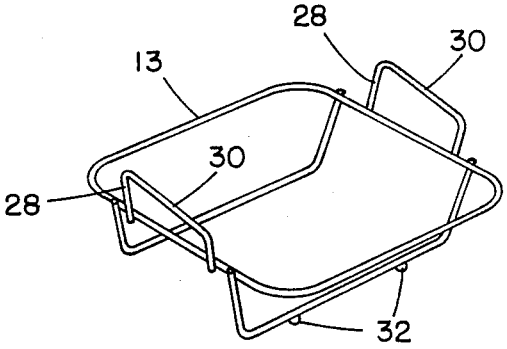

Accordingly, by placing the locator balls at a first position on frame members to be used with angled bases and at a second position on frame members to be used with flat bases, interchangeability of frame members between flat and angled bases is prevented. Specifically, the locator balls for frame members to be used with angled bases are placed further apart than the locator balls for frame members to be used with flat bases. This spacing is illustrated in FIG. 12, where the frame members shown in FIGS. 12A, 12B, and 12C are to be used with angled base members, and the frame member shown in FIG. 12D is to be used with flat base members.

As a result of this positioning, the frame members for use with flat bases can be used with flat bases since such bases include apertures 56 for receiving the balls, but not with angled bases since those bases lack such apertures. Similarly, frame members for use with angled bases can be used with angled bases since such bases have enough space above skirt 54 to receive the balls, but not with flat bases since those bases have insufficient space above the skirt to receive the ball.

Other than the differences regarding the supporting surface and the locator balls, the flat and angled base members have essentially the same construction, e.g., both types of base members include angled panels 50, ribs 44, channels 46, resilient members 48, feet 52, etc. Also, the two types of base members preferably have the same overall width, length, and height so that when assembled together, they produce a uniform, pleasing impression on the customer.

After having been connected to base members, the various frame members are connected to one another by means of handles 28 and, in particular, top portions 30 of those handles. The preferred means for connecting together the frame members is illustrated in FIGS. 7 and 8. Snap connector 58, which is made from, for example, a plastic material, is snapped over top portions 30 of two adjacent handles to releasably connect those handles to one another. The locations of the handles on the various frame members are chosen so that when the frame members are snapped together, the fronts of the base members are in alignment, i.e., transverse alignment, across the front of the retailer's shelf (see FIG. 13). Other means of connecting the frame members together can be used if desired such as, straps, hooks, and the like.

So as to be able to connect frame members carried by angled bases to frame members carried by flat bases, the frame members for flat bases preferably include sloped top portions 30 (see FIG. 12D). The slope of the top portion is equal to the slope of supporting surface 42 for an angled base so that the top portions of the handles of frame members used with flat bases lie in the same plane as the top portions of the handles of frame members used with angled bases (see FIG. 13). In this way, angled and flat bases can be arranged in any desired order in the finished display, i.e., angled bases can be located next to angled bases, angled bases can be located next to flat bases, and flat bases can be located next to flat bases.

Figure 13:
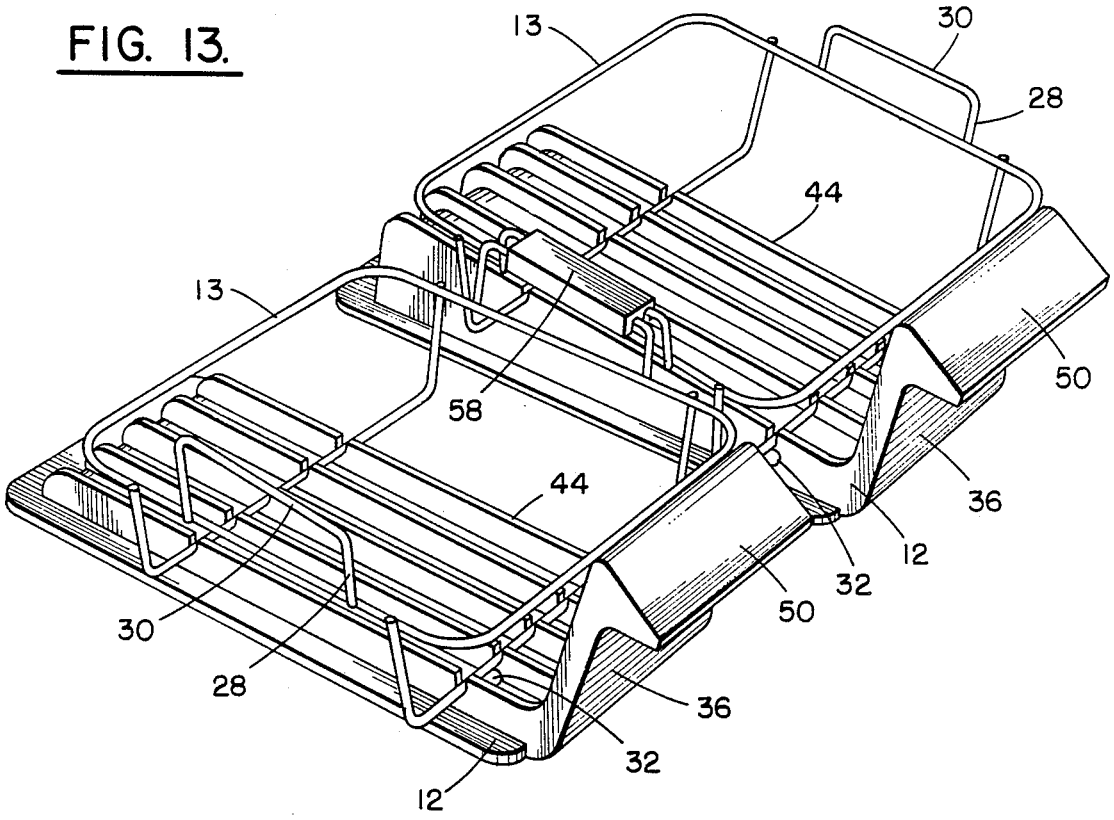
FIG. 13 is a perspective view illustrating two frame member/base member combinations connected to one another to form a unitized display wherein one of the combinations has a flat base member and the other combination has an angled base member.

FIGS. 6 and 13 illustrate some of the types of merchandising systems which can be generated with the present invention. In FIG. 6, three frame members, carried by angled bases and suitable for displaying square, rectangular, and circular wares, have been assembled together. In FIG. 13, both frame members are designed for square-shaped wares, but one frame member has been connected to a flat base and the other to an angled based.

As will be evident from these examples and from the disclosure herein, essentially an infinite set of display systems for displaying any desired number of wares, either on the flat or on an angle, can be readily produced using the present invention. This versatility and the ability to display merchandise on an angle are important advances in the art achieved by the present invention.

Although specific embodiments of the invention have been described and illustrated, it is to be understood that modifications can be made without departing from the invention's spirit and scope. For example, other mechanisms besides those illustrated can be used to prevent the interchange of frame members for angled and flat bases. Along these same lines, the angled based members need not all have supporting surfaces inclined at the same angle, but different angles can be used for different items in a display. Similarly, base and frame members having configurations which are different from those illustrated can be used in the practice of the invention.

What is claimed is:

1. A system for displaying first merchandise and second merchandise, said first merchandise having an outside surface having a first configuration and said second merchandise having an outside surface having a second configuration, said system comprising:

(a) a first frame member having a front, a back, and two sides, and including an opening for receiving the first merchandise, said opening having a configuration which corresponds to the first configuration so that the first merchandise when received in the opening is held in place:

(b) a second frame member having a front, a back, and two sides, and including an opening for receiving the second merchandise, said opening having a configuration which corresponds to the second configuration so that the second merchandise when received in the opening is held in place:

(c) a first base member for supporting the first merchandise, said first base member having a front and a back and being connected to the first frame member with the front of the first frame member being located in the region of the front of the first base member;

(d) a second base member for supporting the second merchandise, said second base member having a front and a back and being connected to said second frame member with the front of the second frame member being located in the region of the front of the second base member: and (e) means for releasably connecting a side of the first frame member to a side of the second frame member to form a unit in which the first frame member is located next to the second frame member and the front of the first base member is in substantial transverse alignment with the front of the second base member.

2. The system of claim 1 wherein the first base member supports the first merchandise substantially horizontally and the second base member supports the second merchandise substantially horizontally.

3. The system of claim 1 wherein the first base member supports the first merchandise substantially horizontally and the second base member supports the second merchandise at a preselected angle above horizontal.

4. The system of claim 1 wherein the first base member supports the first merchandise at a first preselected angle above horizontal and the second base member supports the second merchandise at a second preselected angle above horizontal.

5. The system of claim 4 wherein the first and second preselected angles are substantially equal.

6. The system of claim 1 wherein each side of the first frame member includes a handle, each side of the second frame member includes a handle, the handles being located at substantially equal distances behind the fronts of the first and second base members when the frame members are connected to the base members, and the means for connecting connects a handle of the first frame member to a handle of the second frame member.

7. The system of claim 6 wherein the first base member supports the first merchandise substantially horizontally, the second base member supports the second merchandise at a preselected angle above horizontal, the handles on the first frame member each have a top portion, the handles on the second frame member each have a top portion, the inclination of the top portion of each of the handles on the first frame member when said first frame member is connected to the first base member being substantially equal to the inclination of the top portion of each of the handles on the second frame member when said second frame member is connected to the second base member, and the means for connecting connects a top portion of a handle on the first frame member to a top portion of a handle on the second frame member.

8. The system of claim 7 wherein the inclination of the top portions of the handles is substantially equal to the preselected angle above horizontal.

9. The system of claim 1 wherein the first frame member is releasably connected to the first base member, and the second frame member is releasably connected to the second base member.

10. The system of claim 9 wherein the first frame member includes means which prevent said member from being connected to the second base member, and the second frame member includes means which prevent said member from being connected to the first base member.

11. The system of claim 1 wherein the front of the first base member includes means for identifying the first merchandise and the front of the second base member includes means for identifying the second merchandise.

12. A system for displaying first merchandise and second merchandise, said first merchandise having an outside surface having a first configuration and said second merchandise having an outside surface having a second configuration, said system comprising:

(a) a first frame member having a top, a bottom, a front, a back, and two sides, each side of the member including a handle which extends upward from the top of the member, each handle (i) being located a first predetermined distance from the front of the member and (ii) including a top portion which is substantially parallel to the top of the member, said first frame member including an opening for receiving the first merchandise, said opening having a configuration which corresponds to the first configuration so that the first merchandise when received in the opening is held in place:

(b) a second frame member having a top, a bottom, a front, a back, and two sides, each side of the member including a handle which extends upward from the top of the member, each handle (i) being located a second predetermined distance from the front of the member, said first and second predetermined distances being substantially equal, and (ii) including a top portion which is inclined at a predetermined angle with respect to the top of the member, said second frame member including an opening for receiving the second merchandise, said opening having a configuration which corresponds to the second configuration so that the second merchandise when received in the opening is held in place:

(c) a first base member for supporting the first merchandise at a preselected angle above horizontal, the preselected angle being substantially equal to the predetermined angle, said first base member having a front and a back and being releasably connected to the first frame member with the front of the first frame member being located a first preselected distance behind the front of the first base member:

(d) a second base member for supporting the second merchandise substantially horizontally, said second base member having a front and a back and being releasably connected to said second frame member with the front of the second frame member being located a second preselected distance behind the front of the second base member, said first preselected distance being substantially equal to said second preselected distance; and (e) means for releasably connecting a top portion of a handle of the first frame member to a top portion of a handle of the second frame member to form a unit in which the first frame member is located next to the second frame member and the front of the first base member is in substantial transverse alignment with the front of the second base member.

13. The system of claim 12 wherein the first frame member includes means which prevent said member from being connected to the second base member, and the second frame member includes means which prevent said member from being connected to the first base member.

14. The system of claim 12 wherein the front of the first base member includes means for identifying the first merchandise and the front of the second base member includes means for identifying the second merchandise.

15. Apparatus for displaying merchandise at a preselected angle with respect to the horizontal comprising:

(a) a frame member defining a cavity for receiving the merchandise, said cavity having a configuration which corresponds to the outside surface of the merchandise and having a depth such that the merchandise, when received in the cavity and displayed at the preselected angle, is held in place;

(b) a base member for supporting the merchandise and for holding the frame member at the preselected angle, said base member having a front, a back, and a sloped supporting surface, the slope of said surface being equal to the preselected angle: and (c) means for releasably connecting the frame member to the base member.

16. The apparatus of claim 15 wherein the supporting surface slopes upward from the front to the back of the base member.

17. The apparatus of claim 15 wherein the frame member includes two handles which extend upward from the top of the cavity.

18. The apparatus of claim 15 wherein the front of the base member includes means for identifying the merchandise.

19. Apparatus for displaying merchandise comprising:

(a) a frame member defining a cavity for receiving the merchandise, said cavity having a configuration which corresponds to the outside surface of the merchandise and having a depth such that the merchandise, when received in the cavity, is held in place, said frame member including two handles which extend upward from the top of the cavity, each of said handles having a top portion which is sloped at a preselected angle above horizontal:

(b) a base member for supporting the merchandise: and (c) means for releasably connecting the frame member to the base member.

20. The apparatus of claim 19 wherein the front of the base member includes means for identifying the merchandise.

* * * * *